US006837200B2

(12) United States Patent
Ichinosawa

(10) Patent No.: US 6,837,200 B2
(45) Date of Patent: Jan. 4, 2005

(54) VALVE TIMING CONTROL SYSTEM FOR INTERNAL COMBUSTION ENGINE

(75) Inventor: Yoshinori Ichinosawa, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/736,592

(22) Filed: Dec. 17, 2003

(65) Prior Publication Data

US 2004/0139937 A1 Jul. 22, 2004

(30) Foreign Application Priority Data

Jan. 17, 2003 (JP) ..... 2003-008951

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS

2003/0121485 A1 * 7/2003 Strauss ..... 123/90.17

FOREIGN PATENT DOCUMENTS

JP 2002-155714 A 5/2002

* cited by examiner

*Primary Examiner*—Thomas Denion
(74) *Attorney, Agent, or Firm*—Foley & Lardner LLP

(57) ABSTRACT

A valve timing control system includes a first device for changing a mounting angle between driving and driven rotators through relative rotation thereof and including first and second rotating mechanisms coupled to each other in series, and a second device for locking the first device at a mounting-angle position which is suitable for engine start and is set between a most-lagged-angle position and a most-advanced-angle position. The second device includes a first lock mechanism for locking the first rotating mechanism at one of the most-lagged-angle position and the most-advanced-angle position and a second lock mechanism for locking the second rotating mechanism at another position. The first and second rotating mechanisms are locked by the first and second lock mechanisms at opposite positions to maintain the mounting angle at the mounting-angle position suitable for engine start.

20 Claims, 13 Drawing Sheets

VALVE TIMING CONTROL SYSTEM FOR INTERNAL COMBUSTION ENGINE

BACKGROUND OF THE INVENTION

The present invention relates to a valve timing control system for controlling open/close timing of an intake valve and an exhaust valve of an internal combustion engine.

The valve timing control system comprises a driving rotator rotated by a crankshaft and a driven rotator integrated with a camshaft and mounted to the driving rotator so as to produce relative rotation as required. The mounting angle between the driving rotator and the driven rotator is appropriately controlled by mounting-angle changing means comprising a hydraulic actuator.

Typically, the valve timing control system controls lift timing of the engine valve at engine start to the most-lagged-angle side or to the most-advanced-angle side. Recently, study is made to use timing more outward of lift timing at engine start, i.e. timing on the most-lagged-angle side or on the most-advanced-angle side, in accordance with vehicle cruising conditions. In this case, lift timing at engine start, i.e. lift timing which allows engine start, is of necessity timing between the most lagged angle and the most advanced angle. Therefore, at engine start, the mounting-angle changing means need to return the mounting angle to a middle position, i.e. position between a most-lagged-angle position and a most-advanced-angle position.

In order to cope with such technical challenge, JP-A 2002-155714 proposes a valve timing control system which comprises a lock claw provided to one of the driving rotator and the drive rotator in a protrudable and withdrawable way and a recess formed in another and engageable with the lock claw at the middle position. The lock claw is biased by spring means in the lock direction, i.e. direction to be engaged in the recess. During lock released, the lock claw undergoes hydraulic pressure against the spring means.

With this valve timing control system, during ordinary engine operation, the release pressure is applied to the lock claw to allow free change of the mounting angle. At engine stop, the spring means press the lock claw forward with a reduction in hydraulic pressure. And when the mounting angle becomes at the middle position until the engine stops completely, the lock claw is then engaged in the recess. When being not engaged in the recess at engine stop, the lock claw is engaged therein when the driven rotator is fluttered by alternate torque of the camshaft, i.e. varying torque due to biasing force of a valve spring and a profile of a driving cam, during cranking at engine restart.

SUMMARY OF THE INVENTION

With the valve timing control system disclosed in JP-A 2002-155714, however, the fluttering speed of the camshaft with alternate torque is very high, so that at engine start, fluttering often makes the lock claw pass over the recess, leading to difficulty of surely engaging the lock claw in the recess at engine stop. Thus, when the lock claw is not engaged in the recess at engine stop, subsequent engine start cannot be obtained quickly.

It is, therefore, an object of the present invention to provide a valve timing control system for an internal combustion engine, which allows sure lock of the mounting angle between the driving rotator and the driven rotator at an angle position between the most-lagged-angle position and the most-advanced-angle position, and thus achievement of quick engine start.

The present invention provides generally a system for controlling a valve timing in an internal combustion engine, which comprises: a driving rotator rotated by a crankshaft of the engine; a driven rotator provided to a camshaft of the engine, the driven rotator having the driving rotator mounted to produce relative rotation; a first device which changes a mounting angle between the driving rotator and the driven rotator through relative rotation thereof, the first device comprising first and second rotating mechanisms coupled to each other in series, each rotating mechanism having a rotation range restricted at a predetermined angle; and a second device which locks the first device at a mounting-angle position suitable for engine start, the mounting-angle position being set between a most-lagged-angle position and a most-advanced-angle position, the second device comprising a first lock mechanism which locks the first rotating mechanism at one of the most-lagged-angle position and the most-advanced-angle position and a second lock mechanism which locks the second rotating mechanism at another of the most-lagged-angle position and the most-advanced-angle position, the first and second rotating mechanisms being locked by the first and second lock mechanisms at opposite positions to maintain the mounting angle at the mounting-angle position suitable for engine start.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
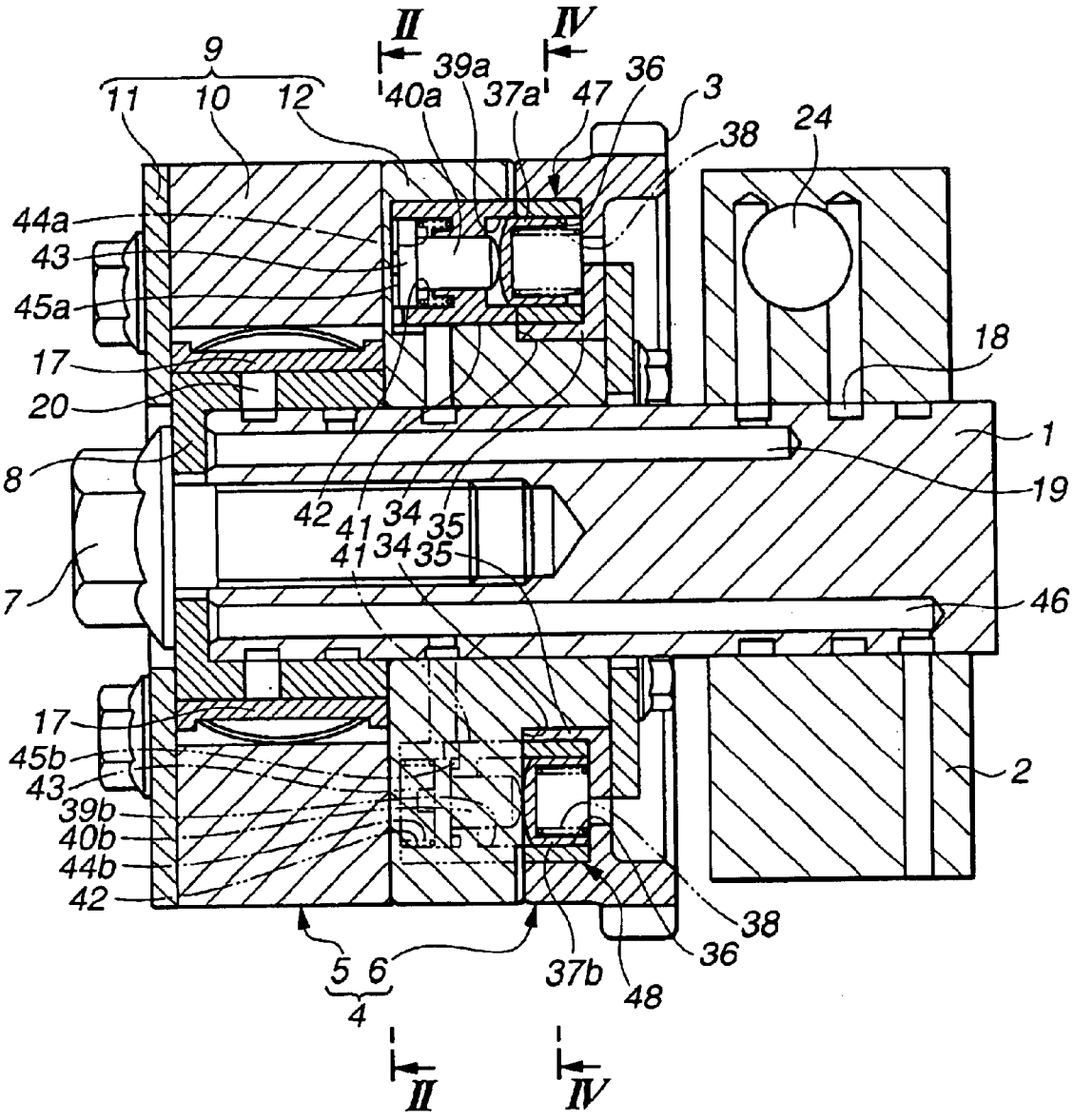
FIG. 1 is a longitudinal sectional view showing a first embodiment of a valve timing control system for an internal combustion engine according to the present invention.

Referring to the drawings wherein like reference numerals designate like parts throughout the views, a description is made about a valve timing control system for an internal combustion engine embodying the preset invention.

Referring to FIGS. 1–11, there is shown first embodiment of the present invention. Referring to FIG. 1, a camshaft 1 is rotatably supported on a cylinder head 2 of an internal combustion engine. The valve timing control system is arranged at a front end of camshaft 1. Camshaft 1 is arranged on the intake side, and includes a basic part with which a driving cam, not shown, for opening and closing an intake valve, not shown, is integrated. In the first embodiment, camshaft 1 itself constitutes a driven rotator.

The valve timing control system comprises a chain sprocket or driving rotator 3 rotated by a crankshaft, not shown, of the engine through a timing chain or the like, camshaft 1 having chain sprocket 3 mounted at the front end to produce relative rotation as required, mounting-angle changing means or device 4 arranged between chain sprocket 3 and camshaft 1 for operating the mounting angle therebetween, and lock means or device for allowing lock of mounting-angle changing means 4 at a mounting-angle position suitable for engine start and comprising first and second lock mechanism 33, 47. In the first embodiment, the mounting-angle position suitable for engine start is set roughly at a middle position, i.e. position between the most-lagged-angle position and the most-advanced-angle position.

Figure 2:
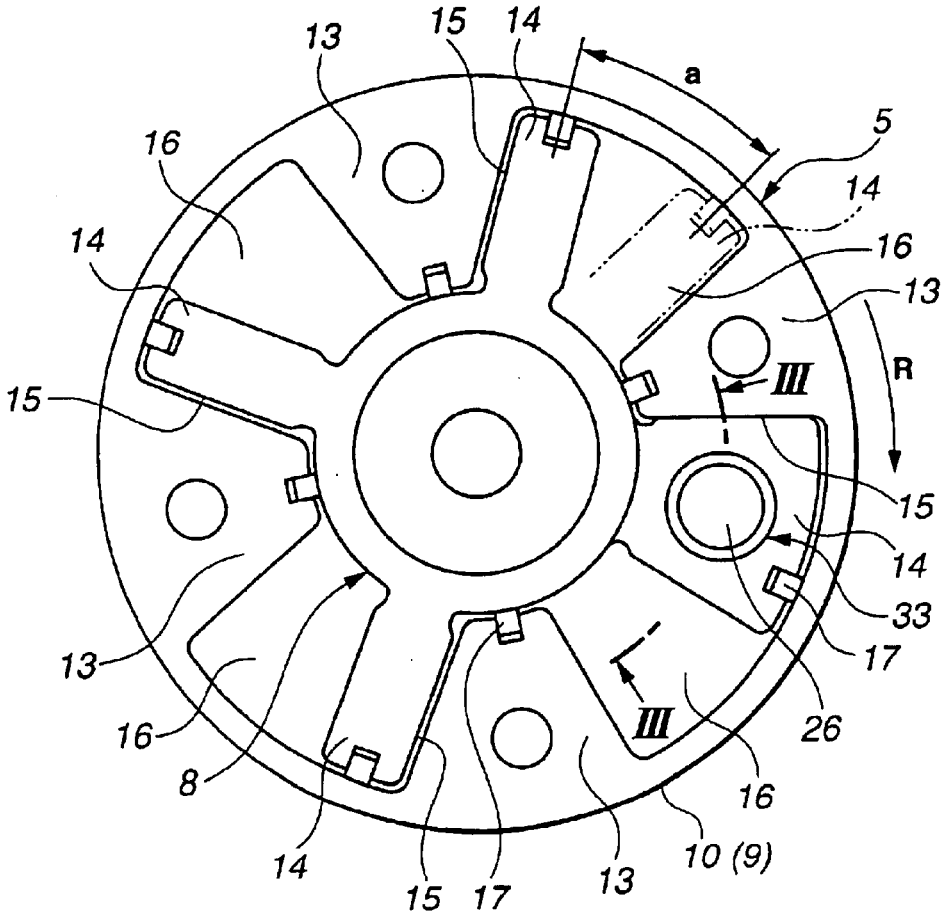
FIG. 2 is a cross sectional view taken along the line II—II in FIG. 1.
Figure 6:
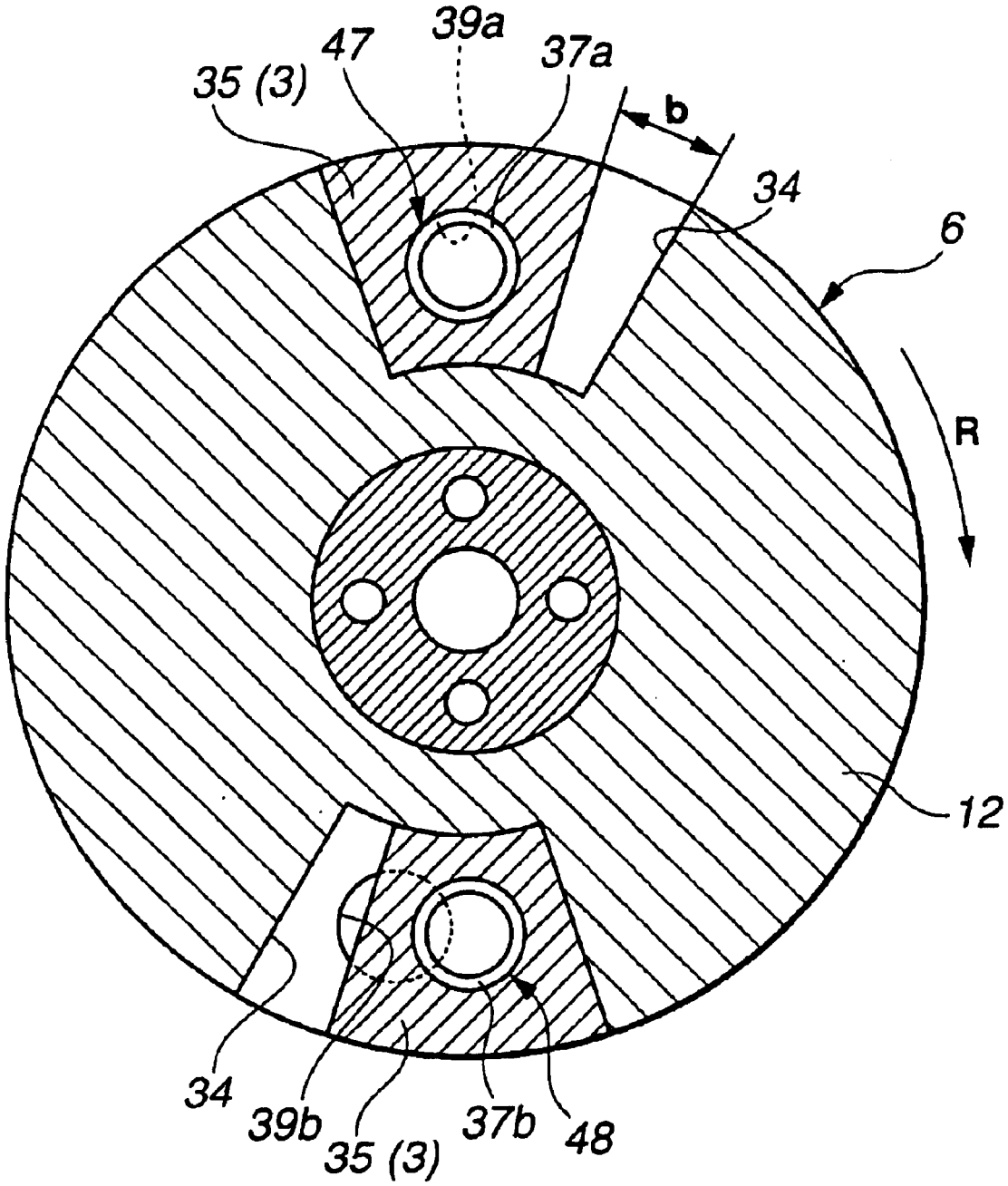
FIG. 6 is a view similar to FIG. 2, taken along the line VI—VI in FIG. 1.

Mounting-angle changing means 4 comprises a first rotating mechanism 5 driven the hydraulic pressure and a second rotating mechanism 6 driven by alternate torque of camshaft 1. Referring to FIGS. 2 and 6, first rotating mechanism 5 is controlled in rotation in the range of a set angle "a" during ordinary engine operation, whereas second rotating mechanism 6 is temporarily returned to the advanced-angle side by a set angle "b" only at engine start. The relationship between maximum rotation ranges "a", "b" of first and second rotating mechanisms 5, 6 is given roughly by a=2b.

Figure 4:
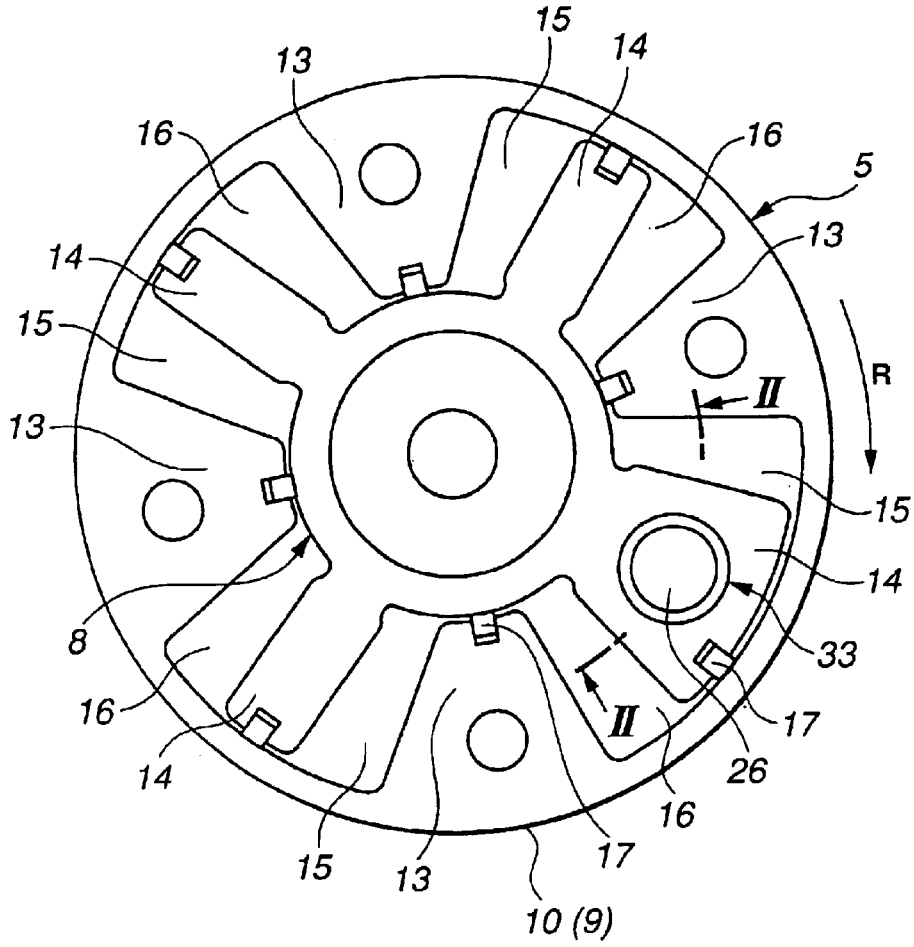
FIG. 4 is a view similar to FIG. 2, showing a first rotating mechanism.

First rotating mechanism 5 comprises a vane rotor 8 integrally coupled to the front end of camshaft 1 by a cam bolt 7 and a housing 9 rotatably mounted to the front end of camshaft 1 in such a way as to surround vane rotor 8. Housing 9 is obtained by coupling a front cover 11 and a rear block 12 to a roughly cylindrical main body 10 from the axially front and back direction thereof. Referring to FIGS. 2 and 4, four partition walls of trapezoidal section are protrusively arranged at roughly 90° intervals on the inner peripheral face of housing main body 10.

Referring to FIGS. 2 and 4, vane rotor 8 comprises four vanes 14 protrusively arranged at roughly 90° intervals on the outer periphery of a roughly cylindrical body, four vanes 14 being disposed between adjacent partition walls 13, 13 of housing 9. Relative rotation of housing 9 and vane rotor 8 is restricted by vanes 14 abutting on partition walls 13, the restricted range or rotation admissible range of which corresponds to set angle "a". An advance-angle chamber 15 is defined between one side face of vane 14 of vane rotor 8 and facing partition wall 13, whereas a lag-angle chamber 16 is defined between another side of vane 14 and facing partition wall 13. Therefore, this apparatus includes four pairs of advance-angle chamber 15 and lag-angle chamber 16. Spring-biased seal members 17 are mounted to front ends of vane 14 and partition wall 13, respectively, to provide fluid-tightness between adjacent chambers.

Figure 7:
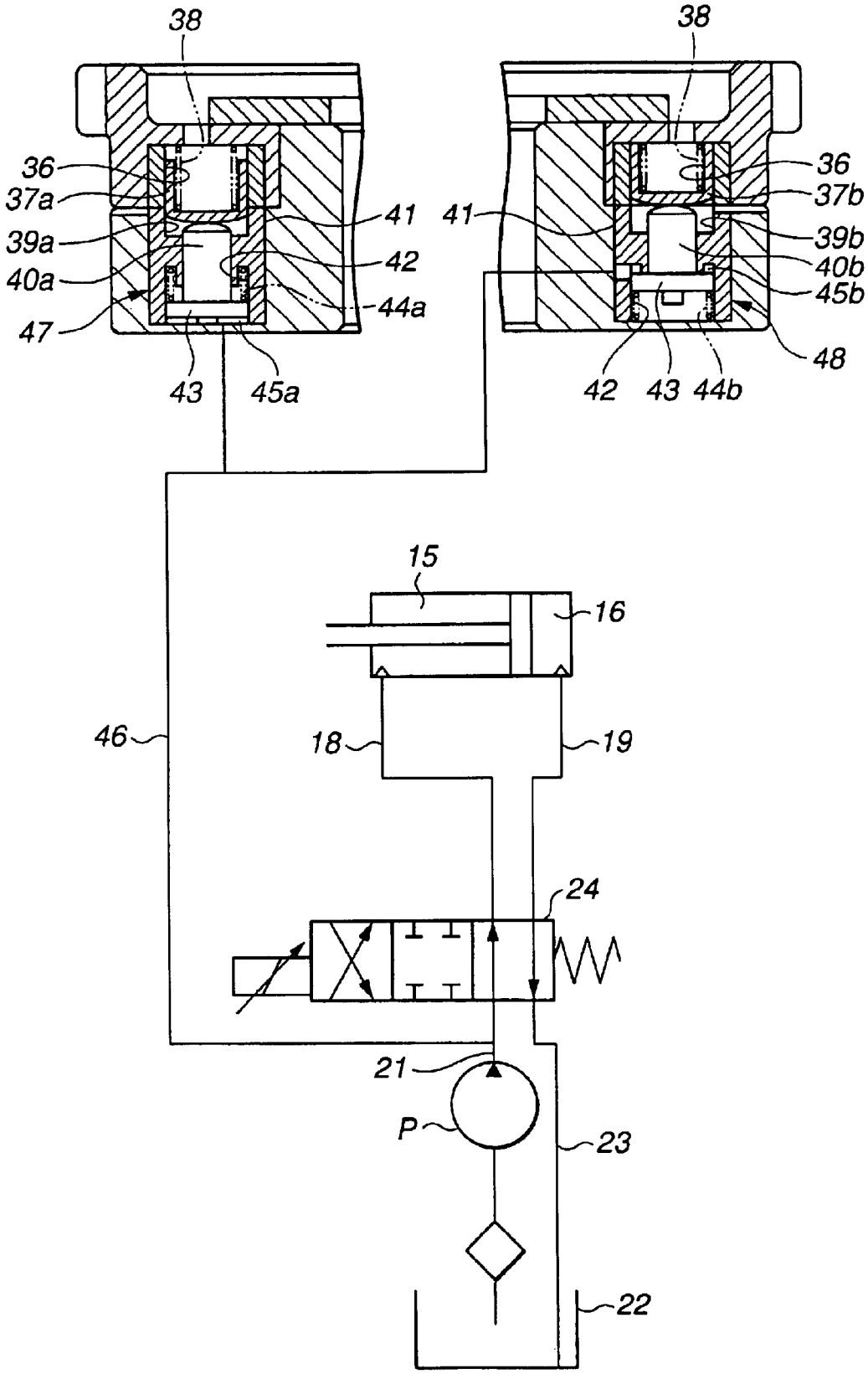
FIG. 7 is a diagram showing a hydraulic circuit.

First and second supply/discharge passages 18,19 are formed in camshaft 1 to communicate with cylinder head 2 through a bearing, whereas a first radial hole 20 and a second radial hole, not shown, are formed in the body of vane rotor 8 to provide communication between advance-angle and lag-angle chambers 15, 16 and first and second supply/discharge passages 18, 19. First and second supply/discharge passages 18, 19 are connected to a hydraulic circuit as shown in FIG. 7. In the hydraulic circuit, a supply passage 21 connected to an oil pump P and a drain passage 23 communicating with an oil pan 22 are connected to first and second supply/discharge passages 18, 19 through a solenoid selector valve 24. Selector valve 24 is appropriately controlled by an electronic control unit (ECU), not shown, in accordance with engine operating conditions to control supply/discharge of hydraulic fluid to/from advance-angle and lag-angle chambers 15,16. Oil pump P is driven by engine power to provide pump operation in synchronization with engine operation.

Figure 3:
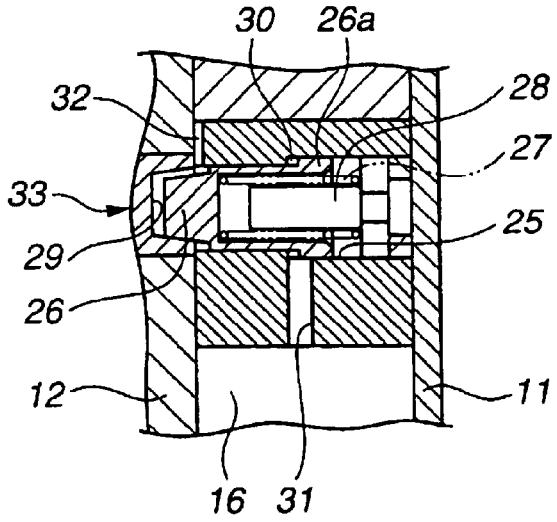
FIG. 3 is a sectional view taken along the line III—III in FIG. 2.
Figure 5:
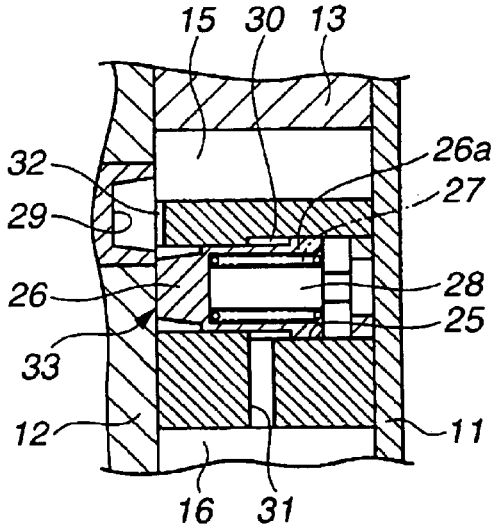
FIG. 5 is a view similar to FIG. 3, taken along the line V—V in FIG. 4.

Referring to FIGS. 3 and 5, a pin hole 25 is formed in one vane 14 of vane rotor 8, and a lock pin 26, a spring 27 for biasing lock pin 26 toward rear block 12, and a retainer 28 for supporting one end of spring 27 are accommodated therein. A lock opening 29 is formed in a side face of rear block 12 on the side of housing main body 10, in which the tip of lock pin 26 is engaged when vane rotor 8 is rotated up to the most-lagged-angle position with respect to housing main body 10, i.e. when vane 14 abuts on one side face of partition wall 13 to restrict rotation.

Pin hole 25 is formed with the diameter reduced stepwise from front cover 11 to rear block 12. A flange 26*a* is provided to a base end of lock pin 26 so as to slidably be engaged in a large-diameter portion of pin hole 25. A space between the stepped face of pin pole 25 and flange 26*a* of lock pin 26 serves as a pressure chamber 30, into which hydraulic fluid of lag-angle chamber 16 is introduced through a communication hole 31 formed through vane 14 of vane rotor 8. A guide groove 32 is formed in vane 14 with pin hole 25 on a side face opposite to rear block 12 to provide communication between advance-angle chamber 15 and an edge of pin hole 25. Hydraulic fluid of advance-angle chamber 15 is guided to the tip of lock pin 26 through guide groove 32.

As a result, lock pin 26 undergoes the pressures of both advance-angle chamber 15 and lag-angle chamber 16 against biasing force of spring 27. Thus, when one of the pressures within advance-angle chamber 15 and lag-angle chamber 16 exceeds a set value with lock pin 26 engaged in lock opening 29, lock pin 26 is disengaged from lock opening 29, thereby obtaining lock released. In the first embodiment, first lock mechanism 33 for locking rotation of first rotating mechanism 5 comprises lock pin 26, lock opening 29, spring 27, and the above lock releasing structure.

Second rotating mechanism 6 comprises rear block 12 of first rotating mechanism 5 and chain sprocket 3 rotatably mounted thereto, and is driven by alternate torque of camshaft 1 provided to rear block 12 during rotation of camshaft 1. Since rear block 12 serves as both an output-side member of second rotating mechanism 6 and an input-side member of first rotating mechanism 5, two rotating mechanisms 5, 6 are coupled together in series through rear block 12.

Referring to FIGS. 1 and 6, rear block 12 is shaped roughly cylindrically as a whole, and has a pair of sector-like cavities 34 formed in the outer periphery of the end face on the opposite side of housing main body 10. On the other hand, chain sprocket 3 is formed with sector-like stopper protrusions 35 to be inserted into cavities 34 of rear block 12. By stopper protrusion 35 abutting on the wall of corresponding cavity 34, the range of rotation of second rotating mechanism 6 is restricted to set angle "b". The radially opposite wall surfaces of cavity 34 and stopper protrusion 35 include concentric circular faces, which slidably make contact with each, other to rotatably support chain sprocket 3 on rear block 12.

Pin holes 36 are formed in stopper protrusions 35 of chain sprocket 3 to open to the bottom face of cavities 34. Bottomed cylindrical lock pins 37*a*, 37*b* are slidably accommodated in pin holes 36, and springs 38 for biasing lock pins 37*a*, 37*b* in the protruding direction are also accommodated therein. The tip of lock pins 37*a*, 37*b* is formed with roughly a spherically curved surface.

On the hand, lock openings 39*a*, 39*b* are formed in rear block 12 to open to the bottom surface of cavities 34, and operation pins 40*a*, 40*b* are provided to the bottom of lock openings 39*a*, 39*b* in a protrudable and withdrawable way. In the first embodiment, lock openings 39*a*, 39*b* are not directly formed in rear block 12, but by front-end openings of cylindrical blocks 41 press fitted in rear block 12. Cylindrical block 41 comprises a partition wall forming the bottom surface of lock opening 39*a*, 39*b* and a recess 42 arranged opposite to lock openings 39*a*, 39*b* across the partition wall and defining a cylinder chamber between cylinder block 41 and rear block 12. Operation pin 40*a*, 40*b* has a base end formed with a flange 43 for diving recess 42 into front and rear chambers and a front end arranged through the partition wall to protrude into lock opening 39*a*, 39*b*.

Figure 9:
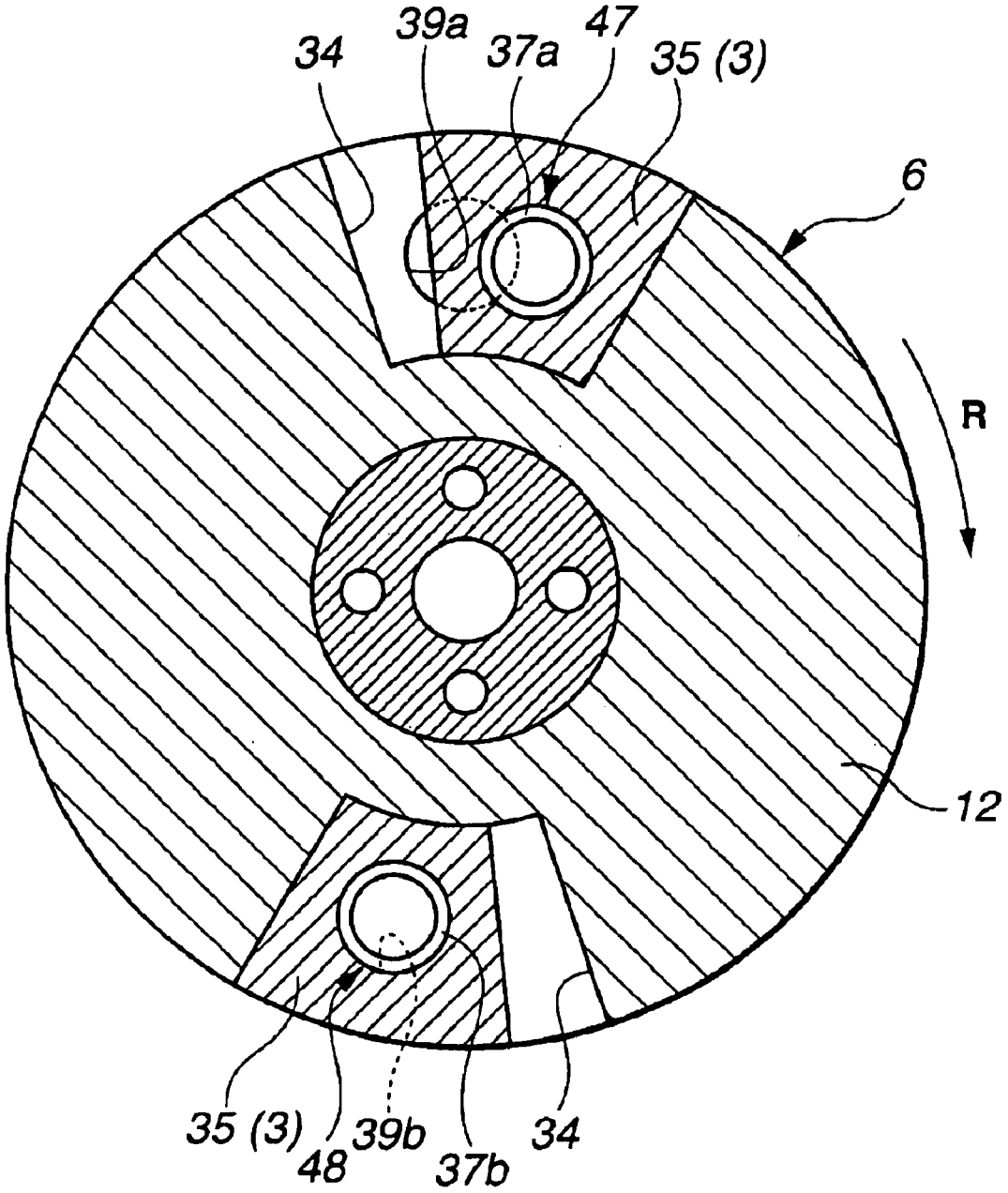
FIG. 9 is a view similar to FIG. 6, taken along the line IX—IX in FIG. 8.
Figure 10:
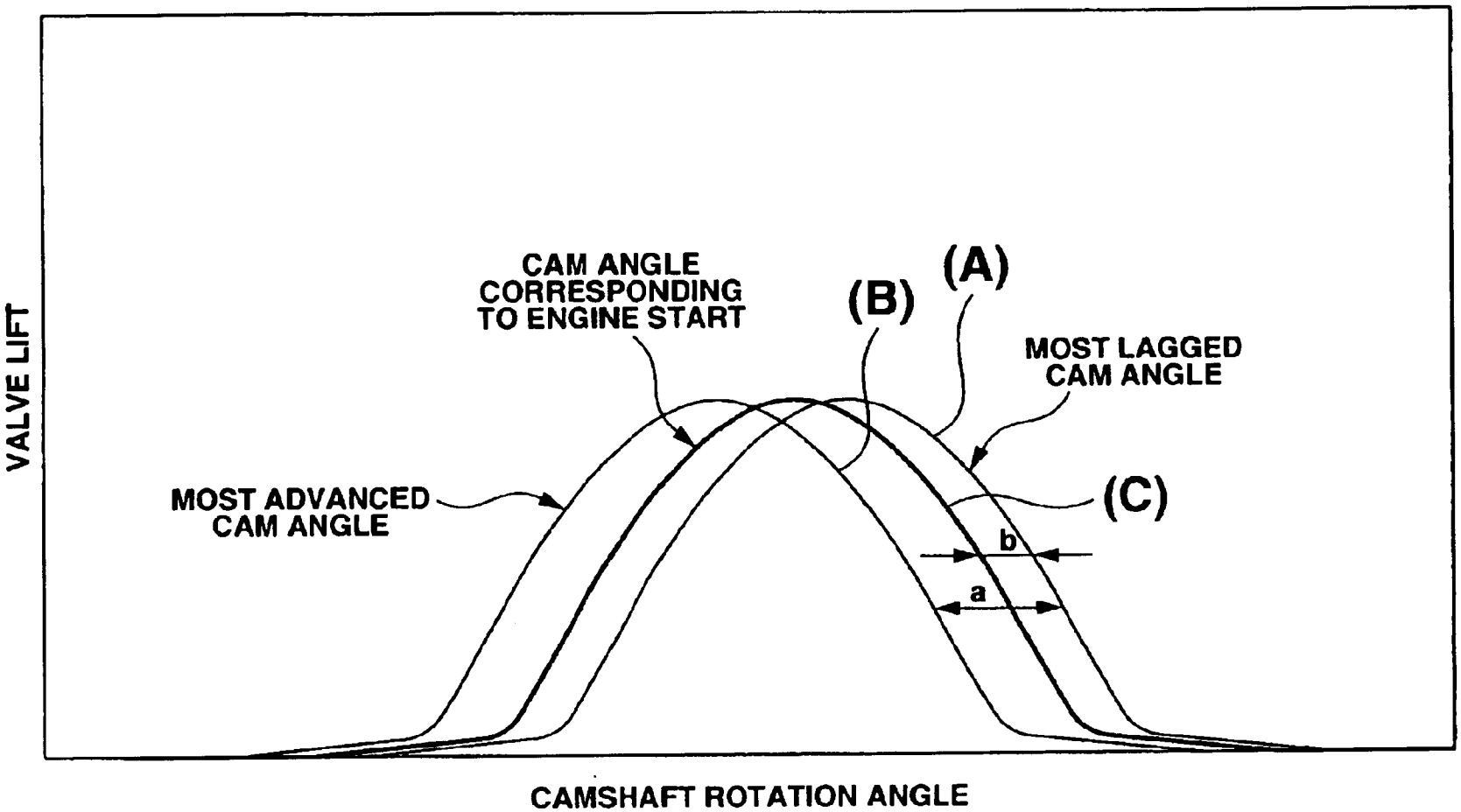
FIG. 10 is a graph illustrating a characteristic of valve lift vs. camshaft rotation angle.
Figure 11:
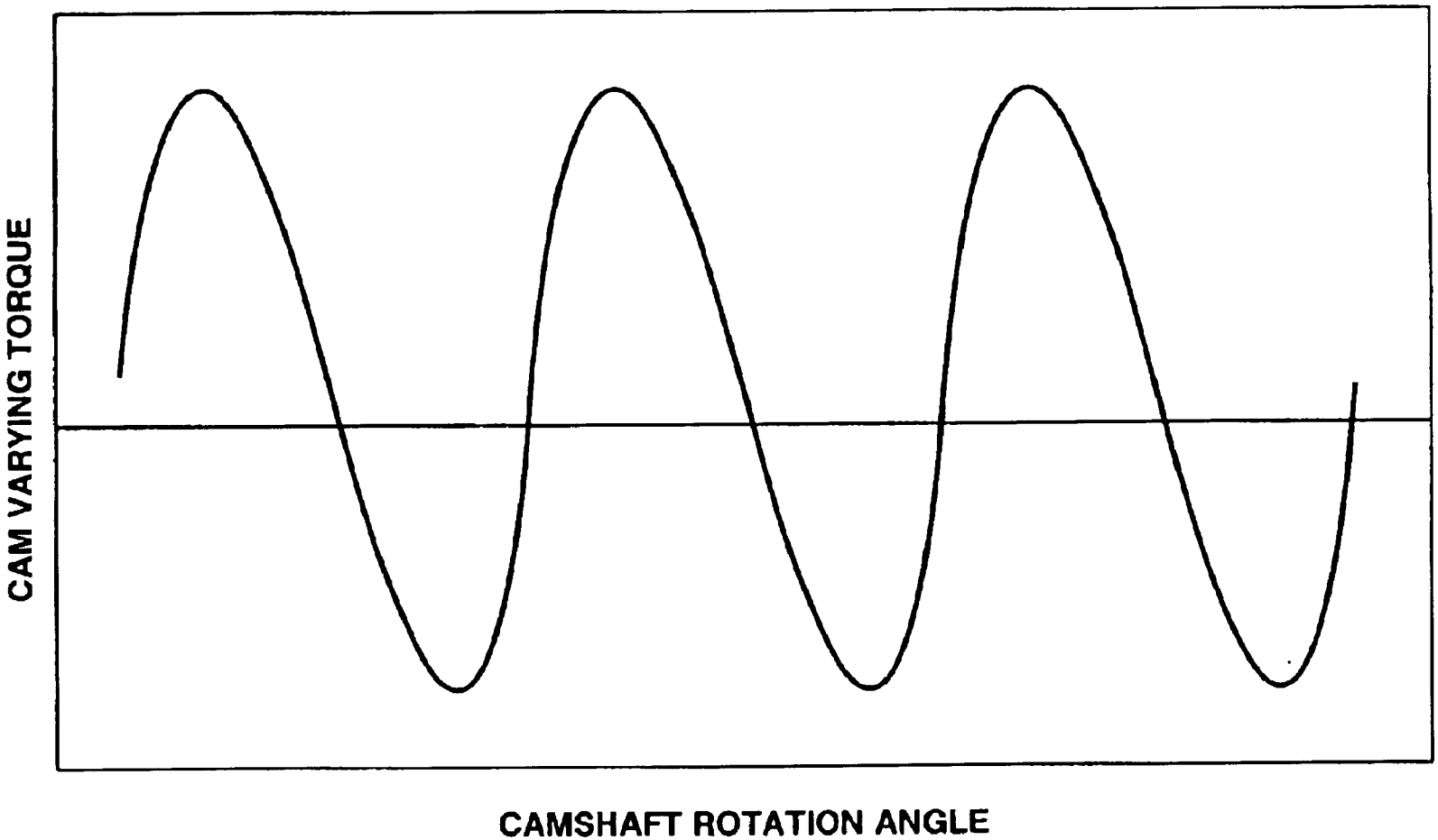
FIG. 11 is a graph similar to FIG. 10, illustrating a characteristic of varying torque vs. camshaft rotation angle.

Lock openings 39*a*, 39*b* are arranged to be engageable with lock pins 37*a*, 37*b*, respectively, wherein lock opening 39*a* conforms positionally to lock pin 37*a* when rear block 12 is rotated maximally to the advance-angle side with respect to chain sprocket 3 as shown in FIG. 6, and lock opening 39*b* conforms positionally to lock pin 37*b* when rear block 12 is rotated maximally to the lag-angle side with respect to chain sprocket 3 as shown in FIG. 9.

Operation pin 40*a* corresponding to lock opening 39*a* is biased in the backward direction by a spring 44*a*, and has a pressure chamber 45*a* arranged on the back side of flange 43 to receive hydraulic fluid. On the other hand, operation pin 40*b* corresponding to lock opening 39*b* is biased in the forward direction by a spring 44*b*, and has a pressure chamber 45*b* arranged on the front side of flange 43 to receive hydraulic fluid. Therefore, referring to FIG. 1, while the pressure within pressure chambers 45*a*, 45*b* is less than a set value, operation pin 40*a* is moved backward under biasing force of spring 44*a* to substantially open lock opening 39*a*, whereas operation pin 40*b* is moved forward under biasing force of spring 44*b* to substantially close lock opening 39*b*. Thus, when rear block 12 is displaced to a maximum restricted position on the advance-angle side as shown in FIG. 6, lock pin 37*a* is engaged in lock opening 39*a* as shown in FIG. 1, then having lock maintained.

Figure 8:
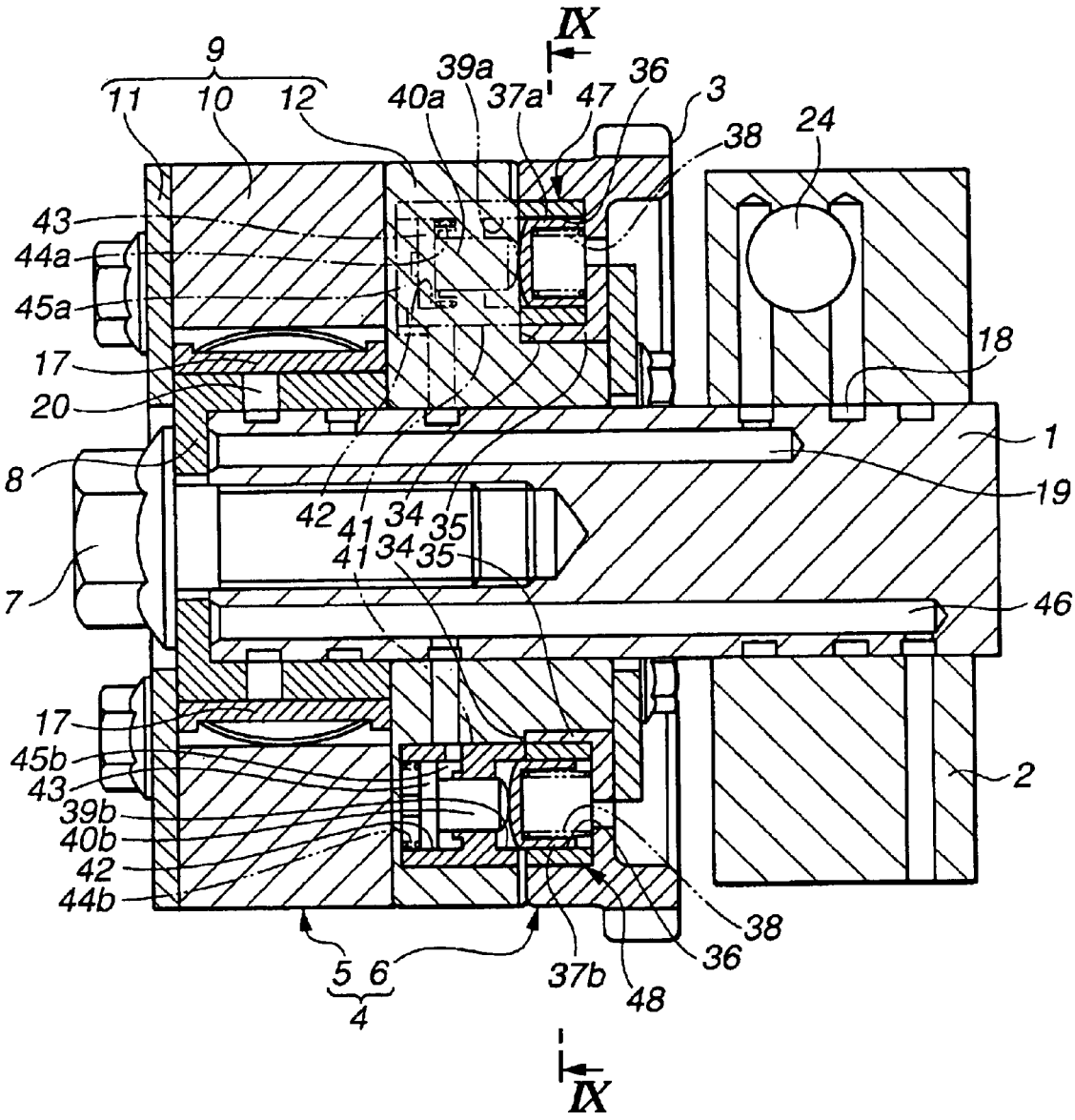
FIG. 8 is a view similar to FIG. 1, showing the valve timing control system.

Pressure chambers 45*a*, 45*b* are connected to supply passage 21 in the hydraulic circuit as shown in FIG. 7 through a third supply/discharge passage 46 extending from rear block 12 to camshaft 1. Therefore, referring to FIG. 8, when the discharge pressure of oil pump P exceeds a set value with engine start, operation pin 40*a* is moved forward against biasing force of spring 44*a* to substantially close lock opening 39*a*, whereas operation pin 40*b* is moved backward against biasing force of spring 44*b* to substantially open lock opening 39*b*. Thus, when rear block 12 is displaced to a maximum restricted position on the lag-angle side as shown in FIG. 9, lock pin 37*b* is engaged in lock opening 39*b* as shown in FIG. 8, then having lock maintained. Hereafter refer to the position where rear block 12 is maximally displaced to the lag-angle side as a reference position of second rotating mechanism 6. Operation pin 40*a*, 40*b* is restricted in maximum protrusion amount to have an end face roughly at the same level as an edge of lock opening 39*a*, 39*b*.

In the first embodiment, second lock mechanism 47 comprises lock pin 37*a*, lock opening 39*a*, spring 38, and the lock releasing hydraulic circuit, whereas a third lock mechanism 48 comprises lock pin 37*b*, lock opening 39*b*, spring 38, and the lock releasing hydraulic circuit.

With the valve timing control system, during ordinary engine operation, second rotating mechanism 6 is locked at the reference position by third lock mechanism 48, wherein first rotating mechanism 33 is hydraulically controlled within the range of rotation angle "a". During engine stop, first rotating mechanism 33 is returned to the most-lagged-angle side by alternate torque of camshaft 1. Specifically, referring to FIG. 11, alternate torque of camshaft 1 has an absolute value of one (upper) component greater than that of another (lower) component, so that when the control pressure is reduced at engine stop, first rotating mechanism 5 is pushed back to the most-lagged-angle side by one component of alternate torque.

In the above structure, when the open/close phase of the intake valve is changed during engine operation, first and second supply/discharge passages 18, 19 are connected to supply passage 21 and drain passage 23, respectively, through switching control of selector valve 24 shown in FIG. 7, achieving supply of high-pressure hydraulic fluid to lag-angle chamber 16 and discharge of hydraulic fluid from advance-angle chamber 15. With this, vane rotor 8 is rotated up to the most-lagged-angle position with respect to housing 9 as shown in FIG. 2, thus changing the phase of open/close timing of the intake valve as shown by a curve (A) in FIG. 10.

When open/close timing of the intake valve is then changed to the most-advanced-angle side, supply/discharge of hydraulic fluid to/from first and second supply/discharge passages 18, 19 is carried out in an opposite way to the above, thereby rotating vane rotor 8 of first rotating mechanism 5 to the most-advanced-angle position with respect to housing 9. With this, the open/close phase of the intake valve is changed as shown by a curve (B) in FIG. 10. The open/close phase of the intake valve can be changed not only to the most-lagged-angle phase and the most-advanced-angle phase, but alto to any phase through switching control of selector valve 24. Since the above actions are carried out during engine operation, second rotating mechanism 6 is locked at the reference position shown in FIGS. 8 and 9.

When the engine is stopped by turn-off of an igniting key or the like during engine operation, the hydraulic pressure is reduced with reduction in rotation of oil pump P, so that first rotating mechanism 5 is returned to the most-lagged-angle position by alternate torque of camshaft 1. Then, when the hydraulic pressure acting on lock pin 26 of first lock mechanism 33 becomes less than a set value, lock pin 26 is engaged in lock opening 29 of rear block 12, thereby locking first lock mechanism 33 on the most-lagged-angle side.

Then, second rotating mechanism 6 is held locked at the reference position by third lock mechanism 48 while the hydraulic pressure has a certain high value. When the hydraulic pressure becomes less than a set value, lock of lock pin 37*b* of third lock mechanism 48 is released. When second rotating mechanism 6 is fluttered to the advance-angle side after lock of third lock mechanism 48 is released, lock pin 37*a* of second lock mechanism 47 is engaged in lock opening 39*a* as stopper protrusion 37*a* abuts on one wall of cavity 34 as shown in FIG. 6, thereby locking second rotating mechanism 6 on the advance-angle side. When fluttering of second rotating mechanism 6 does not occur after releasing lock of third lock mechanism 3, second rotating mechanism 6 is located at a rotated position on the lag-angle side as shown in FIG. 9.

The following operation is carried out when the engine is started in this state.

When second rotating mechanism 6 is locked on the advance-angle side during engine stop: Since first and second rotating mechanisms 5, 6 are already locked at the most-advanced-angle position and the most-lagged-angle position, respectively, at engine stop, the mounting angle between rotating mechanisms 5, 6 is roughly at a middle position advanced from the most-lagged-angle position by rotation angle "b". Therefore, when engine start is then carried out, first and second rotating mechanisms 5, 6 are held locked during cranking where the hydraulic pressure within oil pump P does not rise in the same way as during engine stop, so that the engine is started at the middle mounting-angle position which is suitable for engine start. Then, the open/close phase of the intake valve is given by a curve (C) in FIG. 10.

When second rotating mechanism 6 is not locked on the advance-angle side during engine stop: During engine stop, first rotating mechanism 5 is locked at the most-lagged-angle position, while second rotating mechanism 6 is displaced on the lag-angle side without being locked at either of the positions. When cranking is then carried out, second rotating mechanism 6 is fluttered by alternate torque of camshaft 1. And as rear block 12 is rotated to the most-advanced-angle position with respect to chain sprocket 3, i.e. it is restricted in rotation, lock pin 26 of second lock mechanism 6 is engaged in lock opening 29, thereby locking second rotating mechanism 6 at the most-advanced-angle position. Therefore, the mounting angle between rotating mechanism 5, 6 thereafter is at the middle position in the same way as described above, so that the engine is started at the middle mounting-angle position which is suitable for engine start.

Thus, the valve timing control system can surely start the engine in either case.

With the engine started, when the discharge pressure of oil pump P is increased with increasing the engine speed to have the pressure within pressure chambers 45*a*, 45*b* of second and third lock mechanisms 47, 48 exceeding a set pressure, operation pin 40*a* of second lock mechanism 47 protrudes to release lock mechanism 47, whereas operating pin 40*b* of third lock mechanism 48 withdraws to allow lock mechanism 48 to be locked. Therefore, second rotating mechanism 47 is then rotated up to the most-lagged-angle position by alternate torque and the like, lock pin 37*b* of third lock mechanism 48 is then engaged in lock opening 39*b*, thereby locking second rotating mechanism 6 at the reference position.

With the valve timing control system, first rotating mechanism 5 is locked at a rotation restricting end on the lagged-angle side by first lock mechanism 33, whereas second rotating mechanism 6 is locked at a rotation restricting end on the advanced-angle side by second lock mechanism 47. Thus, both rotating mechanisms 5, 6 have lock pins 26, 37*a* prevented from passing over lock openings 29, 39*a* due to fluttering and the like with alternate torque, resulting in possible achievement of quick rotation lock. Therefore, the system allows not only quick and sure engine start, but also enhancement in silence due to possibility of immediate stop of fluttering of rotating mechanisms 5, 6.

Further, with the valve timing control system, first rotating mechanism 5 to be returned to the most-lagged-angle position at engine stop is driven hydraulically, and second rotating mechanism 6 coupled thereto in series is driven by alternate torque only, rotating mechanisms 5, 6 can always surely be returned to the mounting-angle position where engine start is allowed without being affected by the outside-air temperature when it is cold.

Specifically, since first rotating mechanism 5, which is driven hydraulically, has rotation lock at the lag-angle position at engine stop (point immediately before engine full stop), hydraulic fluid introduced into advance-angle chamber 15 and lag-angle chamber 16 is fully warmed up by the engine, having sufficiently low viscous resistance. As a result, even when the outside-air temperature is low, an increase in viscous resistance of hydraulic fluid causes no inconvenience that first rotating mechanism 5 does not return to the lock position. On the other hand, at engine restart which is often carried out after a long time of engine stop, hydraulic fluid can be cooled down during that time by the outside-air temperature to have increased viscous resistance. However, at engine start, with first rotating mechanism 5 locked at the most-lagged-angle position, second rotating mechanism 6 is rotated to the most-advanced-angle position by alternate torque only, having immunity to the viscous resistance of hydraulic fluid.

Furthermore, with the valve timing control system, provided to second rotating mechanism 6 are second lock mechanism 47 which produces lock operation at the most-advanced-angle position and third lock mechanism 48 which produces lock operation at the most-lagged-angle position. And lock mechanisms 47, 48 are selectively switched to the lock released state in accordance with the hydraulic pressure. Thus, second rotating mechanism 6 is temporarily locked at the most-advanced-angle position only during cranking for engine start, and it is locked at the most-lagged-angle position during ordinary engine operation thereafter, allowing stable mounting-angle control through first rotating mechanism 5 only.

Figure 12:
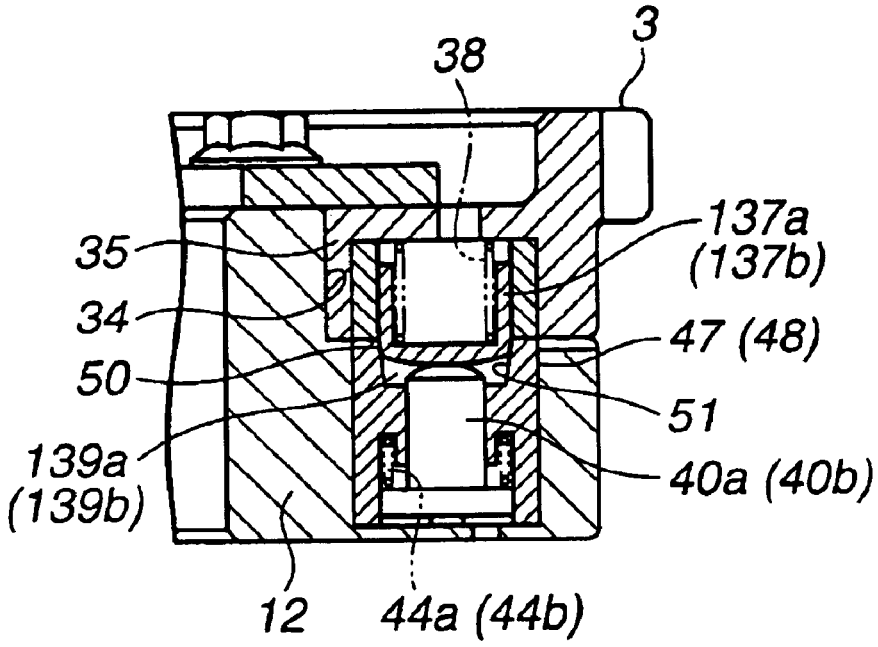
FIG. 12 is a view similar to FIG. 5, showing a second embodiment of the present invention.
Figure 13:
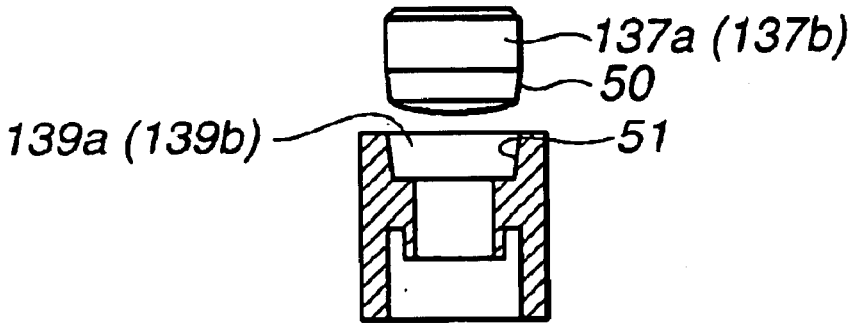
FIG. 13 is an exploded sectional view showing the second embodiment.

Referring to FIGS. 12 and 13, there is shown second embodiment of the present invention which is substantially the same as the first embodiment except that second and third lock mechanisms 47, 48 comprise lock pins 137*a*, 137*b* and lock openings 139*a*, 139*b* which are different in shape from those in the first embodiment.

In the first embodiment, lock pins 37*a*, 37*b* and lock openings 39*a*, 39*b* are shaped straightly, whereas in the second embodiment, lock pins 137*a*, 137*b* and lock openings 139*a*, 139*b* are formed with taper faces 50, 51 which are engageable with each other. Specifically, taper face 50 is formed at the tip of lock pin 137*a*, 137*b*, whereas tape face 51 is formed on the inner periphery of lock opening 139*a*, 139*b* to reduce the diameter toward the bottom. When undergoing biasing force in the protruding direction at the position roughly opposite to lock opening 139*a*, 139*b*, lock pin 137*a*, 137*b* has a tip guided by lock opening 139*a*, 139*b* for sure engagement therein.

In the second embodiment, therefore, second and third lock mechanisms 47,48 can provide quicker and surer lock of lock second rotating mechanism 6.

Figure 14:
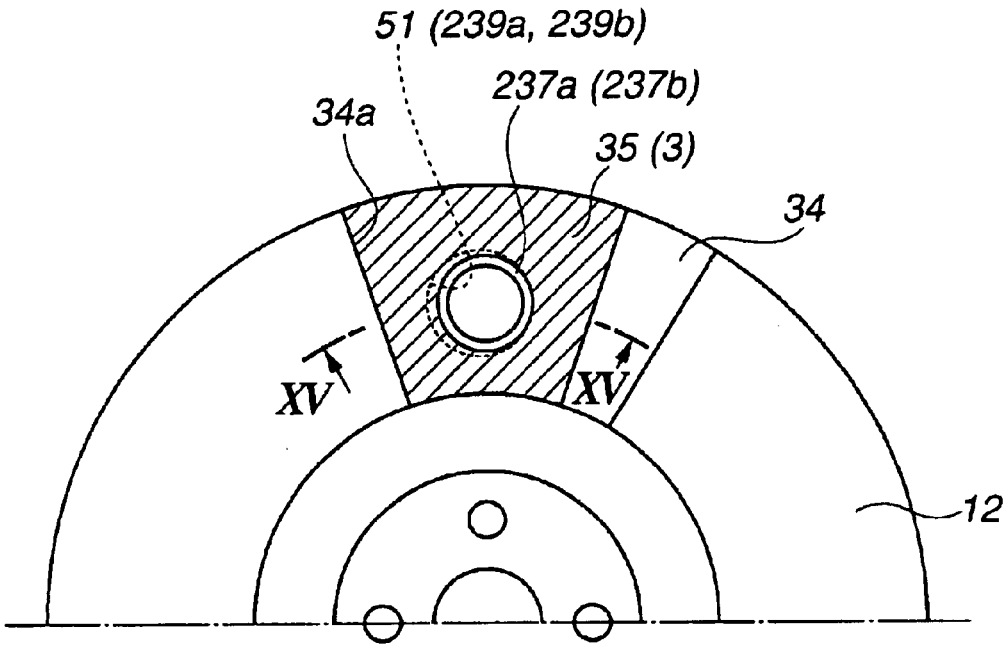
FIG. 14 is a fragmentary sectional view showing a third embodiment of the present invention.
Figure 15:
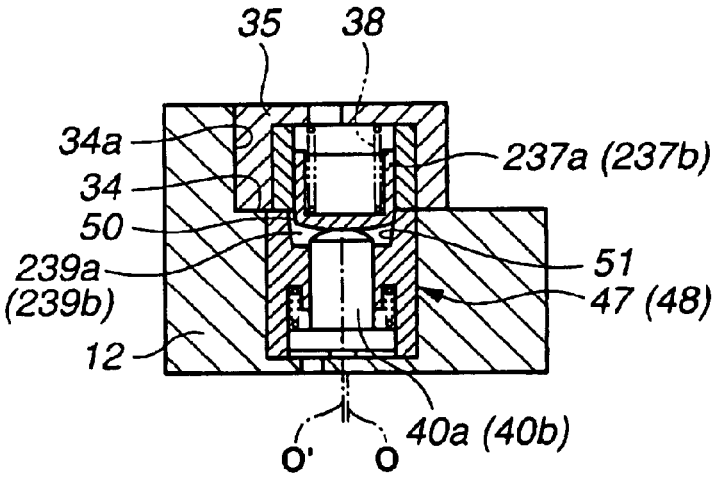
FIG. 15 is a view similar to FIG. 12, taken along the line XV—XV in FIG. 14.

Referring to FIGS. 14 and 15, there is shown third embodiment of the present invention which is substantially the same as the first embodiment except lock pins 237*a*, 237*b* and lock openings 239*a*, 239*b* of second and third lock mechanisms 47, 48.

In the third embodiment, lock pins 237*a*, 237*b* and lock openings 239*a*, 239*b* are also formed with taper faces 50, 51. A taper center O' of lock opening 239*a*, 239*b* when second rotating mechanism 6 is rotated up to one rotation restricting end is slightly offset in the direction of a restriction wall 34*a* of cavity 34 with respect to a taper center O' of lock pin 237*a*, 237*b*.

In the third embodiment, an area of taper face 50 of lock opening 239*a*, 239*b* on the opposite side of restriction wall 34*a* produces a wedge action for pressing stopper protrusion 35 against restriction wall 34*a* during lock operation. Specifically, when lock pin 237*a*, 237*b* is pressed against the area of lock opening 239*a*, 239*b* on the opposite side of restriction wall 34*a* under biasing force of spring 38, lock pin 237*a*, 237*b* undergoes force from taper face 51 of lock opening 239*a*, 239*b* in the direction of making taper centers O, O' coincide with each other, thus obtaining stopper protrusion 35 strongly pressed against restriction wall 34*a*.

In the third embodiment, therefore, a wedge action of taper face 51 allows always accurate lock of second rotating mechanism 6 at the rotation restricting end.

In the above embodiments, the valve timing control system is applied to a camshaft on the intake side. Optionally, the system can be applied to a camshaft on the exhaust side.

Figure 16:
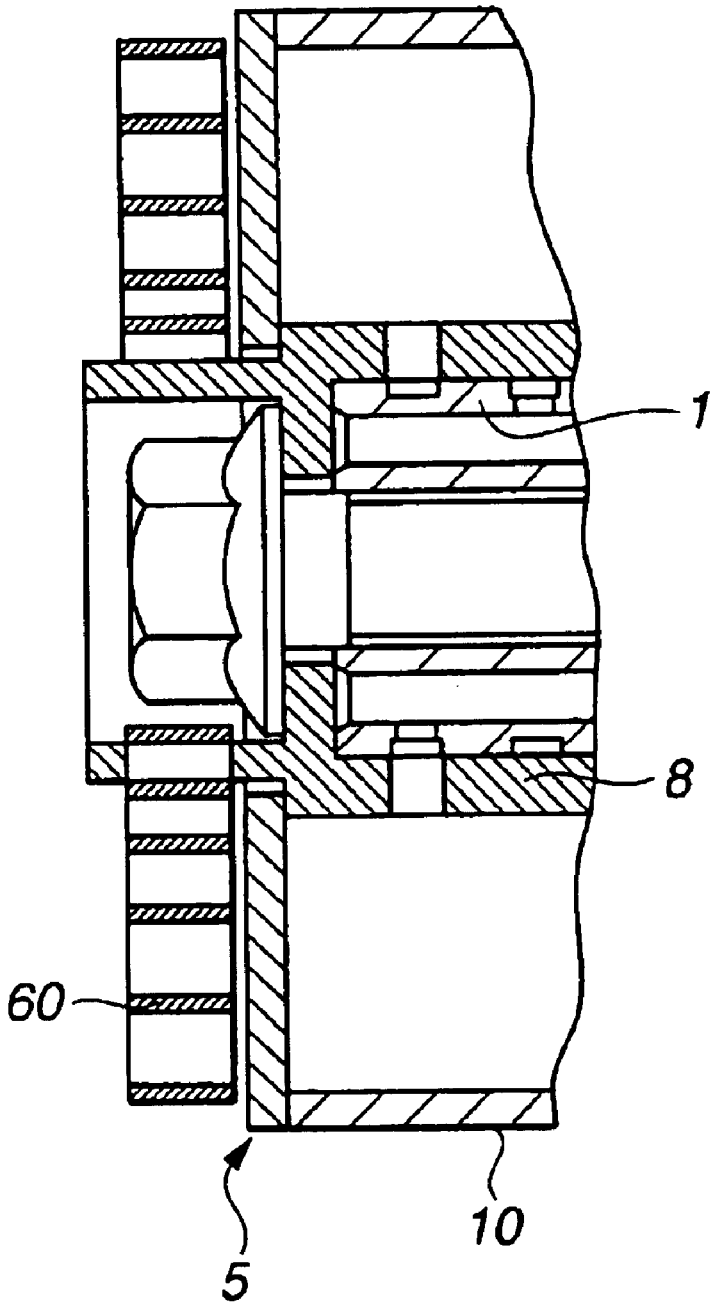
FIG. 16 is a fragmentary longitudinal sectional view showing a fourth embodiment of the present invention.

Referring to FIG. 16, there is shown fourth embodiment of the present invention which is suitably applied to the valve timing control system on the exhaust side. The fourth embodiment is substantially the same in general structure as the first embodiment except that a power spring 60 is interposed between vane rotor 8 and housing 9 which constitute first rotating mechanism 5 to bias vane rotor 8 in the advance-angle direction.

When the valve timing control system is applied to a camshaft on the exhaust side, first and second rotating mechanisms 5, 6 should be locked at the most-advanced-angle position and the most-lagged-angle position, respectively. Alternate torque of camshaft 1 has a lag-angle component greater than an advance-angle component, so that if an attempt is made to rotate first rotating mechanism 5 by alternate torque only during engine stop, first rotating mechanism 5 will be returned to the most-lagged-angle position and not to the most-advanced-angle position as desired. Thus, in the fourth embodiment, power spring 60 is interposed between vane rotor 8 and housing 9 to surely return first rotating mechanism 5 to the advance-angle side at engine stop. The fourth embodiment produces substantially the same effect as the first embodiment.

In the above embodiments, one rotating mechanism (first rotating mechanism 5) driven hydraulically is directly coupled to the front end of camshaft 1, and another rotating mechanism (second rotating mechanism 6) driven by alternate torque only is arranged between the one rotating mechanism and chain sprocket 3. Optionally, referring to FIG. 17, rotating mechanisms 5, 6 can be disposed in a reversed way.

Figure 17:
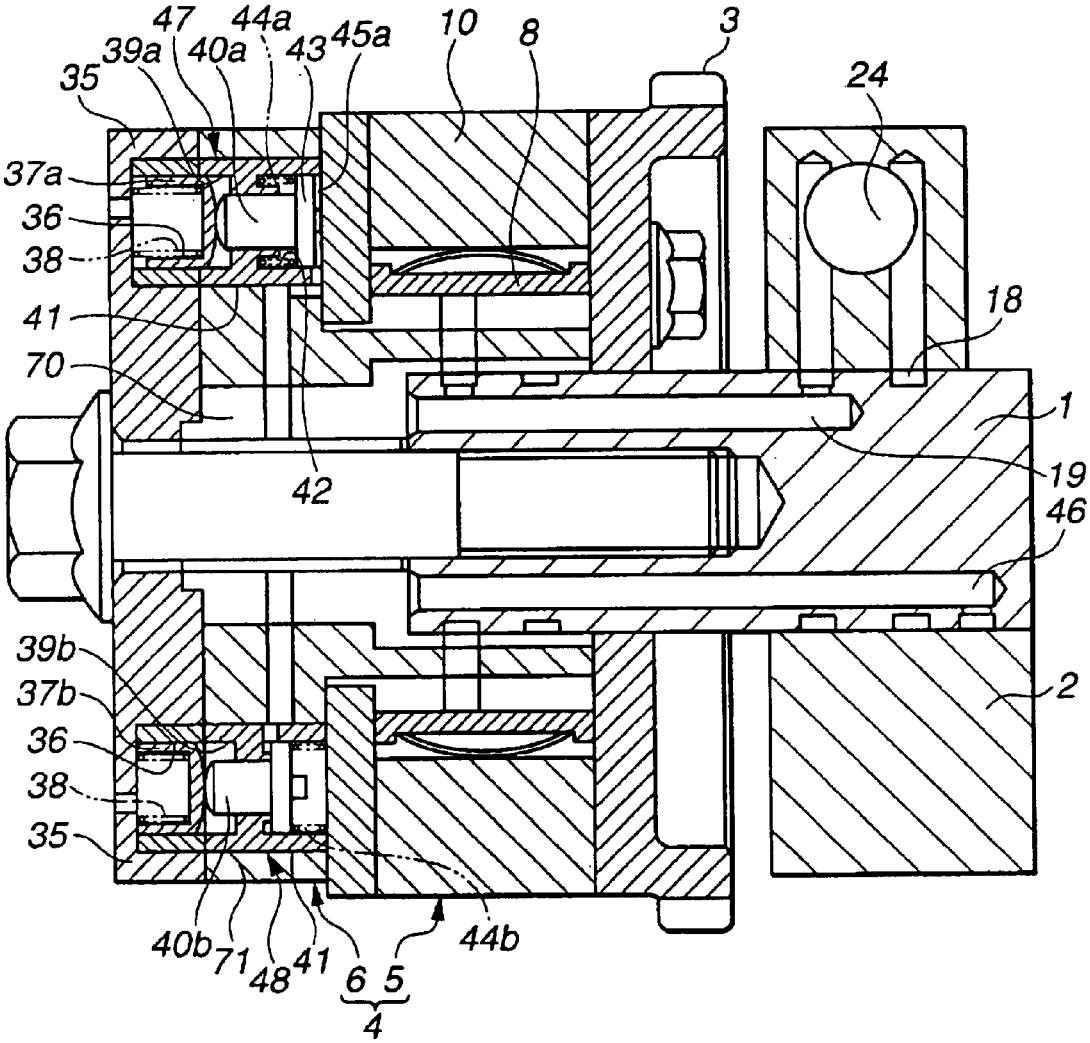
FIG. 17 is a view similar to FIG. 8, showing a fifth embodiment of the present invention.

Referring to FIG. 17, there is shown fifth embodiment of the present invention wherein a driven shaft member 70 having stopper protrusion 35 at the front end is coupled to camshaft 1, and a front block 71 is rotatably mounted thereto, driven shaft member 70 and front block 71 constituting second rotating mechanism 6. Stopper protrusion 35 is inserted into a cavity of front block 71. Relative rotation of driven shaft member 70 and front block 71 is allowed within the range that stopper protrusion 35 abuts on the side wall of the cavity. Front block 71 in the fifth embodiment corresponds to rear block 12 in the first embodiment. Second and third lock mechanisms 47, 48 similar to those in the first embodiment are arranged between stopper protrusions 35 and front blocks 71, respectively.

Vane rotor 8 is integrally provided to the outer periphery of the base end of driven shaft member 70, and housing 9 integrated with chain sprocket 3 is rotatably arranged at the perimeter of vane rotor 8. Vane rotor 8 and housing 9 constitute first rotating mechanism 5, which is restricted in rotation within the range of set angle. The first lock mechanism, not shown, similar to that in the first embodiment is arranged between vane rotor 8 and housing 9.

The fifth embodiment is the same in fundamental function as the first embodiment though it has different layout of first and second rotating mechanisms 5, 6.

According to the invention in claim 1, when changing the mounting angle between the driving rotator and the driven rotator to an angle position suitable for engine start, one of the first and second rotating mechanisms is put at the most-lagged-angle position, and another is put at the most-advanced-angle position, which are then locked by lock mechanisms. The rotating mechanisms are locked at rotation restricting ends, thus failing to be rotated passing over lock positions. Therefore, the mounting angle can surely be locked at an angle position between the most-lagged-angle position and the most-advanced-angle position, resulting in possible quick engine start.

According to the present invention in claim 2, during ordinary engine operation, one of the first and second rotating mechanisms is operated hydraulically to change the mounting angle. At engine stop (point immediately before engine stop), one of the rotating mechanisms is moved to the lock position by alternate torque of the camshaft with reducing hydraulic pressure, which is then locked by the lock mechanism. Then, when cranking is carried out for engine start, another rotating mechanism is fluttered by alternate torque of the camshaft within the rotatable range. And when reaching the lock position opposite to that of one rotating mechanism to have instantaneous stop, another rotating mechanism is locked by the lock mechanism. As a result, the two rotating mechanisms are locked at the opposite rotation restricting ends, maintaining the mounting angle at an angle position between the most-lagged-angle position and the most-advanced-angle position.

At a point immediately before engine stop where the temperature of hydraulic fluid is fully high, one rotating mechanism is surely returned to the lock position by alternate torque of the camshaft without being greatly affected by the viscous resistance of hydraulic fluid. During cranking, another rotating mechanism is varied by alternate torque. Thus, even if cranking is carried out at low temperature, operation of another rotating mechanism which is not actuated hydraulically fails to be obstructed by the viscous resistance of hydraulic fluid. Therefore, another rotating mechanism is surely returned to the lock position during cranking without being affected by the outside-air temperature.

With the valve timing control system using a single rotating mechanism operated hydraulically as mounting-angle changing device or means, even if an attempt is made during cranking to displace the mounting angle to the middle position by using fluttering of the rotating mechanism by alternate torque, operation of the rotating mechanism is obstructed by the viscous resistance of hydraulic fluid which remains in the hydraulic passages. Particularly, since the viscous resistance of hydraulic fluid is very high when it is cold, a large variation in mounting angle is difficult to obtain during cranking, causing impossibility of surely returning the mounting angle to the middle position. However, according to the invention in claim 2, even when it is cold, the mounting angle can surely be returned to the middle position, leading to sure engine start.

According to the invention in claim 3, the rotating mechanism having two lock mechanisms is switched between the lock position at engine start and that during ordinary engine operation, allowing stable adjustment of the mounting angle during ordinary engine operation through another rotating mechanism only.

According to the invention in claim 4, lock of the first and second lock mechanisms at engine start and release thereof after engine start can be achieved with a simple structure.

According to the invention in claim 5, lock of the third lock mechanism at engine start and release thereof after engine start can be achieved with a simple structure.

According to the invention in claim 6, both the first and second rotating mechanisms, particularly, another rotating mechanism can be simplified in structure.

According to the invention in claim 7, as being always engaged in the lock opening by biasing force of the spring, the lock pin provides no larger load than necessary to the lock opening and its peripheral members. Moreover, the lock opening is closed by the opening and closing means during lock released, having no obstruction of relative rotation of the two rotating members.

According to the invention in claim 8, with the simple structure, during cranking where the engine speed is low, the lock pin is engaged in the lock opening to surely lock the rotating mechanism. And when the hydraulic pressure is increased after engine start, the lock pin is withdrawn hydraulically, releasing lock of the rotating mechanism.

According to the invention in claim 9, the second and third lock mechanisms can be obtained with a simple structure. Moreover, by actuating the operation pins of the two lock mechanisms in the opposite directions, selective release operation of the lock mechanisms can be achieved easily.

According to the invention in claim 10, the lock pin and the lock opening can be engaged more easily by a guide action of the tapers.

According to the invention in claim 11, due to wedge action produced at the contact portions of the lock pin and the lock opening, the two rotating members can accurately be locked at the rotation restricting ends.

According to the invention in claim 12, selective release operation of the two lock mechanisms can be achieved easily.

According to the invention in claim 13, when the operation pin protrudes maximally, the end face is roughly at the same level as the edge of the lock opening. Thus, even when the two rotating members are rotated relatively with lock released, there arise no inconvenience that the tip of the operation pin interferes with one rotating member. Therefore, smooth operation of the rotating members with lock released can be obtained.

According to the invention in claim 14, even when the lock pin is withdrawn by pushing of the operation pin against biasing force of the spring to then produce relative rotation of the two rotating members, there arises no inconvenience that the tip of the lock pin is caught at the edge of the lock opening due to curved surface of the top of the lock pin. Therefore, smooth operation of the rotating mechanisms can be obtained with secular damage and deterioration of component parts prevented from occurring.

According to the invention in claim 15, when the hydraulic pressure acting on the two operation pins is low, the operation pin of one lock mechanism protrudes, whereas the operation pin of another lock mechanism withdraws. Then, when the hydraulic pressure acting on the operation pins is increased, the operation pin of one lock mechanism withdraws, whereas the operation pin of another lock mechanism protrudes. Therefore, one lock mechanism can be locked only when having low hydraulic pressure such as during cranking by only applying to the operation pins the hydraulic pressure in accordance with the engine speed.

According to the invention in claim 16, the intake valve can be operated in the open/close phase between the most-lagged-angle phase and the most-advanced-angle phase during cranking.

According to the invention in claim 18, the exhaust valve can be operated in the open/close phase between the most-lagged-angle phase and the most-advanced-angle phase during cranking.

The present invention is not limited to the above illustrative embodiments, and various changes and modifications can be made without departing from the scope of the present invention. By way of example, in the illustrative embodiments, the rotating mechanism as driven hydraulically includes a so-called vane-type actuator. Optionally, the rotating mechanism can include an actuator wherein action of a piston operated hydraulically linearly is converted into rotation through a helical gear.

Further, in the illustrative embodiments, the driving rotator includes chain sprocket 3 driven through a timing chain and the like. Alternatively, the driving rotator may include a pulley driven through a belt or scissors gears meshed with each other.

Still further, in the illustrative embodiments, camshaft 1 serves as a driven rotator. Alternatively, a separate and distinct member may be coupled to camshaft 1 to serve as a driven rotator.

Furthermore, in the illustrative embodiments, second rotating mechanism 5 is driven by alternate torque. Optionally, both first and second rotating mechanisms 5, 6 may be driven hydraulically. In this variation, second rotating mechanism 6 needs biasing means, such as power spring, for biasing rotating mechanism 6 in the direction of being locked by second lock mechanism 47.

Further, in the illustrative embodiments, first, second, and third lock mechanisms 33, 47, 48 include a lock pin, a lock opening, spring means, and the like, and are released or locked hydraulically. Optionally, each lock mechanism may include a lever member and the like engaged in an engagement groove to achieve lock operation. Moreover, release and lock operation can be made through the use of electromagnetic force.

Still further, in the illustrative embodiments, first, second, and third lock mechanisms 33, 47, 48 are disposed to be movable axially, i.e. in the direction of the rotation shaft. Optionally, each lock mechanism can be disposed to be movable radially. Particularly, if second and third lock mechanisms 47, 48 are disposed radially movably, the axial dimension of the system can be reduced.

Further, in the illustrative embodiments, operation pins 40*a*, 40*b* of second and third lock mechanisms 47, 48 are operated with the hydraulic pressure supplied/discharged to/from third supply/discharge passage 46. Alternatively, operation pins 40*a*, 40*b* may be operated by arranging pressure acting faces on operation pins 40*a*, 40*b*, on which the hydraulic pressures within advance-angle chamber 15 and lag-angle chamber 16 of first rotating mechanism 5 are applied. In this variation, there is no need to arrange third supply/discharge passage 46, resulting in not only easy machining, but also enhanced rigidity of camshaft 1.

The entire contents of Japanese Patent Application P2003-8951 filed Jan. 17, 2003 are incorporated hereby by reference.

What is claimed is:

1. A system for controlling a valve timing in an internal combustion engine, comprising:

a driving rotator rotated by a crankshaft of the engine;

a driven rotator provided to a camshaft of the engine, the driven rotator having the driving rotator mounted to produce relative rotation;

a first device which changes a mounting angle between the driving rotator and the driven rotator through relative rotation thereof, the first device comprising first and second rotating mechanisms coupled to each other in series, each rotating mechanism having a rotation range restricted at a predetermined angle; and a second device which locks the first device at a mounting-angle position suitable for engine start, the mounting-angle position being set between a most-lagged-angle position and a most-advanced-angle position, the second device comprising a first lock mechanism which locks the first rotating mechanism at one of the most-lagged-angle position and the most-advanced-angle position and a second lock mechanism which locks the second rotating mechanism at another of the most-lagged-angle position and the most-advanced-angle position, the first and second rotating mechanisms being locked by the first and second lock mechanisms at opposite positions to maintain the mounting angle at the mounting-angle position suitable for engine start.

2. The system as claimed in claim 1, wherein one of the first and second rotating mechanisms is driven by a hydraulic pressure, and another is driven by an alternate torque of the camshaft, wherein the one rotating mechanism is returned to a lock position by the alternate torque before engine stop.

3. The system as claimed in claim 1, wherein one of the first and second rotating mechanisms comprises a third lock mechanism which locks the one rotating mechanism at a rotation restricting end on the opposite side of a lock position of the lock mechanism of the one rotating mechanism, wherein release operation of the two lock mechanisms of the one rotating mechanisms is switched selectively.

4. The system as claimed in claim 1, wherein the first and second rotating mechanisms are controlled by a hydraulic pressure in accordance with an engine speed, wherein when the hydraulic pressure is more than a set value, lock of the two rotating mechanisms is released.

5. The system as claimed in claim 3, wherein the third lock mechanism is controlled by a hydraulic pressure in accordance with an engine speed, wherein the hydraulic pressure is less than a set value, lock of the third rotating mechanism is released.

6. The system as claimed in claim 1, wherein one of the first and second rotating mechanisms is controlled in rotation angle continuously variably, and another is controlled in rotation angle to be switched between the most-lagged-angle position and the most-advanced-angle position.

7. The system as claimed in claim 3, wherein the second and third lock mechanisms each comprise a lock pin provided to one of rotating members of the rotating mechanism in a protrudable and withdrawable way, a lock opening formed in another rotating member and in which the lock pin is engaged when the rotating members produce relative rotation to one rotation restricting end, a spring for biasing the lock pin in a protruding direction, and means for opening and closing the lock opening.

8. The system as claimed in claim 1, wherein the first lock mechanism comprises a lock pin provided to one of rotating members of the rotating mechanism in a protrudable and withdrawable way, and a lock opening formed in another rotating member and in which the lock pin is engaged when the rotating members produce relative rotation to one rotation restricting end, wherein the lock pin is biased by a spring in a protruding direction, and is moved in a withdrawing direction under a hydraulic pressure in accordance with an engine speed.

9. The system as claimed in claim 7, wherein the opening and dosing means comprise an operation pin arranged in the lock opening in a protrudable and withdrawable way.

10. The system as claimed in claim 7, wherein the lock pin and the lock opening are formed with tapers, the tapers being engaged with each other by protrusion of the lock pin.

11. The system as claimed in claim 7, wherein the lock opening is formed with a taper face, the taper face producing a wedge action for guiding a tip of the lock pin to the rotation restricting end when the tip is pressed against the taper face.

12. The system as claimed in claim 9, wherein the operation pin is actuated by a hydraulic pressure.

13. The system as claimed in claim 9, wherein the operation pin is restricted in maximum protrusion to have an end face substantially at the same level as an edge of the lock opening.

14. The system as claimed in claim 9, wherein the operation pin has an end formed with a curved surface.

15. The system as claimed in claim 12, wherein one of the second and third lock mechanisms comprises a spring for biasing the operation pin in a withdrawing direction, and another comprises a spring for biasing the operation pin in a protruding direction, wherein each operation pin undergoes the hydraulic pressure against the spring.

16. The system as claimed in claim 1, wherein the camshaft is provided to the intake side of the engine, wherein during cranking, one of the first and second rotating mechanisms is locked at the most-lagged-angle position, and another is locked at a position displaced to the side of the most-advanced-angle position in the rotation range narrower than a maximum rotation range of the one rotating mechanism.

17. The system as claimed in claim 16, wherein one of the first and second rotating mechanisms is driven by a hydraulic pressure, and another is driven by an alternate torque of the camshaft, wherein the one rotating mechanism is returned to a lock position by the alternate torque before engine stop.

18. The system as claimed in claim 1, wherein the camshaft is provided to the exhaust side of the engine, wherein one of the first and second rotating mechanisms is locked at the most-advance-angle position, and another is locked at a position displaced to the side of the most-lagged-angle position in the rotation range narrower than a maximum rotation range of the one rotating mechanism.

19. The system as claimed in claim 18, wherein one of the first and second rotating mechanisms is driven by a hydraulic pressure, and another is driven by an alternate torque of the camshaft, wherein the one rotating mechanism is returned to a lock position by the alternate torque before engine stop.

20. A system for controlling a valve timing in an internal combustion engine, comprising:

a driving rotator rotated by a crankshaft of the engine;

a driven rotator provided to a camshaft of the engine, the driven rotator having the driving rotator mounted to produce relative rotation;

first means for changing a mounting angle between the driving rotator and the driven rotator through relative rotation thereof, the first means comprising first and second rotating mechanisms coupled to each other in series, each rotating mechanism having a rotation range restricted at a predetermined angle; and second means for locking the first means at a mounting-angle position suitable for engine start, the mounting-angle position being set between a most-lagged-angle position and a most-advanced-angle position, the second means comprising a first lock mechanism which locks the first rotating mechanism at one of the most-lagged-angle position and the most-advanced-angle position and a second lock mechanism which locks the second rotating mechanism at another of the most-lagged-angle position and the most-advanced-angle position, the first and second rotating mechanisms being locked by the first and second lock mechanisms at opposite positions to maintain the mounting angle at the mounting-angle position suitable for engine start.

* * * * *